US008848493B2

(12) United States Patent
Dai

(10) Patent No.: US 8,848,493 B2
(45) Date of Patent: Sep. 30, 2014

(54) ELECTRONIC DEVICE, STORAGE MEDIUM AND METHOD FOR CONTROLLING AN ALARM FUNCTION OF THE ELECTRONIC DEVICE

(75) Inventor: Cheng-Ping Dai, Shenzhen (CN)

(73) Assignees: Shenzhen Futaihong Precision Industry Co., Ltd., Shenzhen (CN); Chi Mei Communications Systems, Inc., New Taipei (TW)

( * ) Notice: Subject to any disclaimer, the term of this patent is extended or adjusted under 35 U.S.C. 154(b) by 270 days.

(21) Appl. No.: 13/457,434

(22) Filed: Apr. 26, 2012

(65) Prior Publication Data

US 2013/0155818 A1 Jun. 20, 2013

(30) Foreign Application Priority Data

Dec. 17, 2011 (CN) ..... 2011 1 0424465

(51) Int. Cl.
*G04C 21/00* (2006.01)

(52) U.S. Cl.
USPC ..... 368/109; 368/250

(58) Field of Classification Search
USPC ..... 368/243–245, 250–251, 107–109
See application file for complete search history.

(56) References Cited

U.S. PATENT DOCUMENTS

| | | | | |
|---|---|---|---|---|
| 7,522,031 | B2 * | 4/2009 | Lim | 340/309.16 |
| 7,633,836 | B2 * | 12/2009 | Choi et al. | 368/11 |
| 2003/0142591 | A1 * | 7/2003 | Baweja et al. | 368/263 |
| 2008/0259742 | A1 * | 10/2008 | Tadanori | 368/263 |
| 2012/0307604 | A1 * | 12/2012 | Wang | 368/245 |

* cited by examiner

*Primary Examiner* — Sean Kayes
(74) *Attorney, Agent, or Firm* — Novak Druce Connolly Bove + Quigg LLP

(57) ABSTRACT

In a method for controlling an alarm function of an electronic device, an alarm time, an alarm mode, a plurality of control modes of the alarm function and a shaking frequency and an audio file corresponding to each of the control modes are set. If a current time matches the alarm time, the alarm function is started by activating the alarm mode and a monitor unit is enabled to monitor acceleration values of the electronic device. A first shaking frequency in a first predetermined time limit is recorded according to the acceleration values. The control mode corresponding to the first shaking frequency is confirmed, and the audio file corresponding to the confirmed control mode is output. The method further controls the alarm function according to the confirmed control mode.

18 Claims, 3 Drawing Sheets

ELECTRONIC DEVICE, STORAGE MEDIUM AND METHOD FOR CONTROLLING AN ALARM FUNCTION OF THE ELECTRONIC DEVICE

BACKGROUND

1. Technical Field

Embodiments of the present disclosure relate to alarm systems and methods, and more particularly to an electronic device, a storage medium and a method for controlling an alarm function of the electronic device.

2. Description of Related Art

Electronic devices often have an alarm function provided to be set to output voice alarms at a specific time. When a current time of the electronic device matches the specific time, the user of the electronic device has to select to turn off the alarm function or repeat the alarm function after a predetermined time delay. Sometimes, the user may open eyes to do the selection of the alarm function. That is, it is not convenient for the user to control the alarm function.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

In general, the word module, as used herein, refers to logic embodied in hardware or firmware, or to a collection of software instructions, written in a programming language, such as, Java, C, or assembly. One or more software instructions in the modules may be embedded in firmware, such as in an EPROM. The modules described herein may be implemented as either software and/or hardware modules and may be stored in any type of non-transitory computer-readable medium or other storage device. Some non-limiting examples of non-transitory computer-readable medium include CDs, DVDs, BLU-RAY, flash memory, and hard disk drives.

Figure 1:
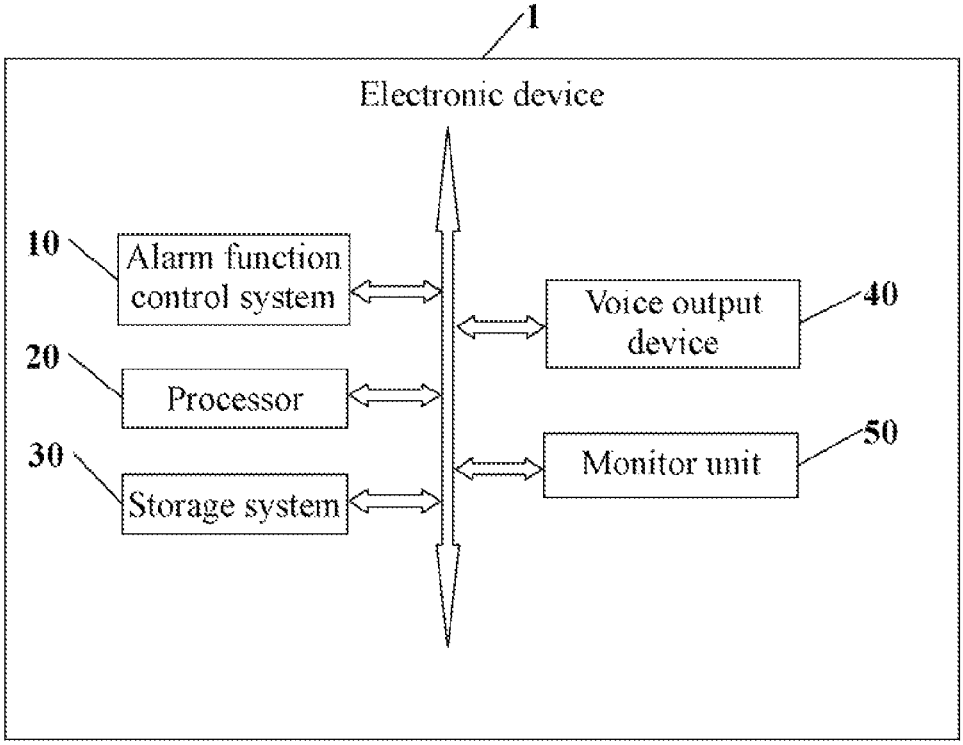
FIG. 1 is a block diagram of one embodiment of an electronic device.

FIG. 1 is a block diagram of one embodiment of an electronic device 1. The electronic device 1 has an alarm function. The electronic device 1 includes an alarm function control system 10, a voice output device 40, and a monitor unit 50. The voice output device 40 may output one or more audio files or other voice information. In one embodiment, the voice output device 40 may be a speaker. The monitor unit 50 may sense acceleration values of the electronic device 1 to determine the electronic device 1 is being moved (e.g., the electronic device 1 is being shaken by a user). In one embodiment, the monitor unit 50 may be an accelerometer. The alarm function control system 10 may control the alarm function of the electronic device 1 according to shaking frequencies of the electronic device 1, and may plays predetermined audio files for prompt the user of the electronic device 1.

The electronic device 1 further includes a processor 20 and a storage system 30. The processor 20 executes one or more computerized codes and other applications for the electronic device 1, to provide the functions of the alarm function control system 10. The storage system 30 stores different kinds of data. The storage system 30 may be a memory, an external storage card, such as a smart media card, or a secure digital card.

Figure 2:
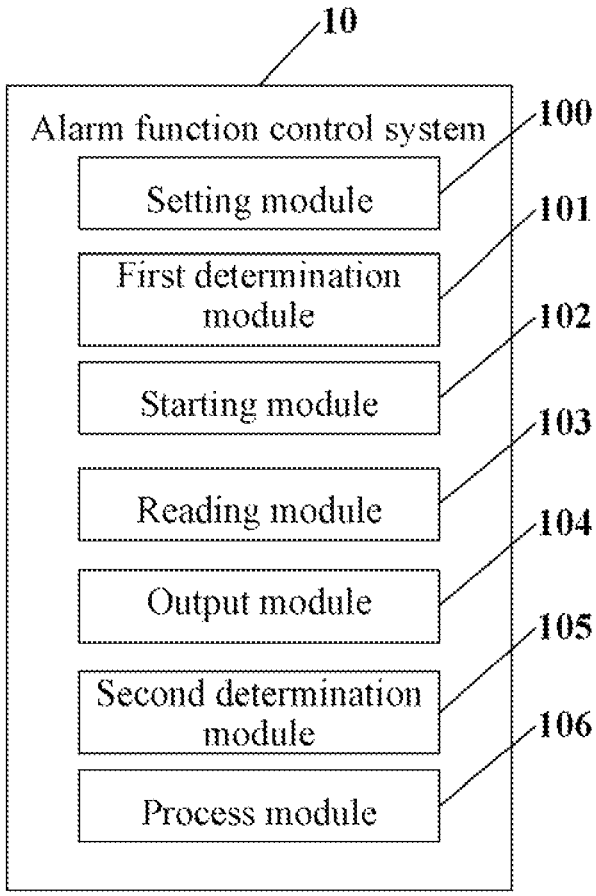
FIG. 2 is a block diagram of function modules of an alarm function control system in the electronic device of FIG. 1.

FIG. 2 is a block diagram of function modules of the alarm function control system 10 in the electronic device 1 of FIG. 1. In one embodiment, the alarm function control system 10 may include a setting module 100, a first determination module 101, a starting module 102, a reading module 103, an output module 104, a second determination module 105, and a process module 106. The modules 100-106 comprise computerized codes in the form of one or more programs that are stored in the storage system 30. The computerized code includes instructions that are executed by the processor 20 to provide functions for the modules. Details of each of the modules are given in FIG. 3.

Figure 3:
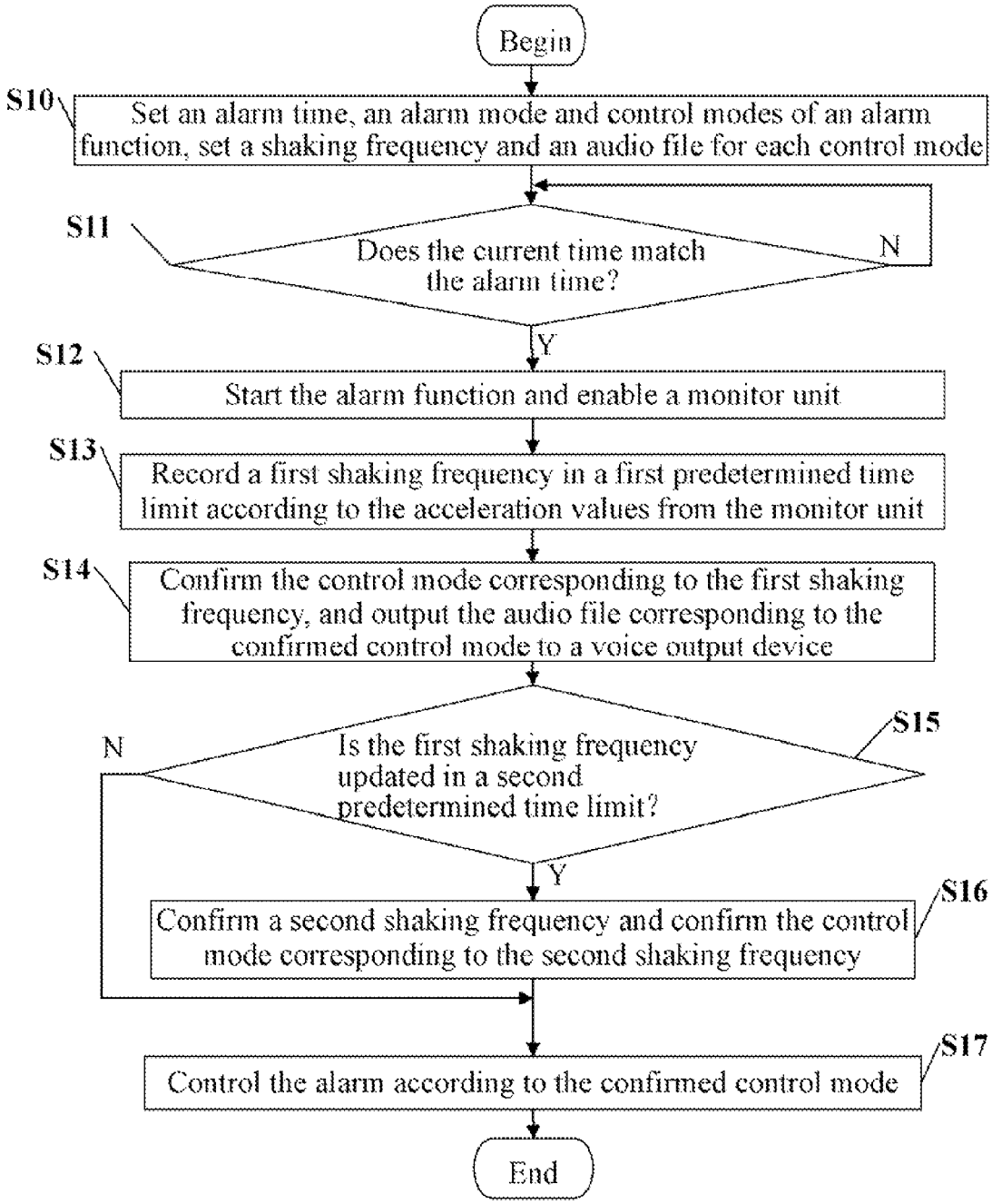
FIG. 3 is a flowchart of one embodiment of a method for controlling an alarm function of the electronic device of FIG. 1.

FIG. 3 is a flowchart of one embodiment of a method for controlling an alarm function of the electronic device of FIG. 1. Depending on the embodiment, additional blocks may be added, others removed, and the ordering of the blocks may be changed.

In block S10, the setting module 100 sets an alarm time, an alarm mode and a plurality of control modes of the alarm function of the electronic device 1, and sets a shaking frequency and an audio file corresponding to each of the control modes in the storage system 30. In one embodiment, the alarm mode may be a ring mode or a vibration mode. The control modes represent different modes of controlling the alarm when a current time of the electronic device 1 matches the alarm time. In one embodiment, the control modes includes a close mode for turning off the alarm function, a first delay mode for the alarm function of the electronic device 1 to ring again after a first time duration (e.g. "5" minutes), a second delay mode to ring again after a second time duration (e.g. "10" minutes), for example.

A value of the shaking frequency represents how many times the electronic device 1 has been shaken. The shaking frequency is a trigger condition for triggering different control modes of the electronic device 1. The audio file of each of the control modes includes voice content of the each of the control modes, for indicating that which control mode has been chosen. For example, the value of the shaking frequency corresponding to the close mode may be set as "1", and the audio file corresponding to the close mode may include the voice content of "turn off the alarm function". In one embodiment, the user of the electronic device 1 shakes the electronic device with the shaking frequency corresponding to one of the control modes to choose the control mode.

In block S11, the first determination module 101 determines whether the current time of the electronic device 1 matches the alarm time. If the current time of the electronic device 1 matches the alarm time, block S12 is implemented. If the current time of the electronic device 1 does not match the alarm time, block S11 is repeated until the current time of the electronic device 1 matches the alarm time.

In block S12, the start module 102 starts the alarm function of the electronic device 1 by activating the alarm mode, and enables the monitor unit 50 to monitor the acceleration values of the electronic device 1.

In block S13, the reading module 103 reads the acceleration values from the monitor unit 50, and records a first shaking frequency of the electronic device 1 in a first predetermined time limit (e.g. 5 seconds) according the acceleration values. An initial value of the first shaking frequency is set as 0. In one embodiment, if one of the acceleration values exceeds a predetermined shaking value, the reading module 103 confirms that the electronic device 103 is shaken one time, and increments the value of the first shaking frequency by one. The predetermined shaking value is a threshold value for indicating that the electronic device 1 has been shaken one time.

In block S14, the output module 104 confirms the control mode corresponding to the first shaking frequency of the electronic device 1, and outputs the audio file corresponding to the confirmed control mode by the voice output device 40. The voice output device 40 outputs the audio file to prompt that the confirmed control mode has been chosen. For example, if the recorded value is equal to 2, the output module 104 confirms that the control mode is the first delay mode to ring again after "5" minutes according to the recorded value "2", then the audio file of "ring again after 5 minutes" is output by the voice output device 40. In one embodiment, if there is no control mode corresponding to the recorded value, the output module 104 first confirms a closest value of the set shaking frequency of the recorded value, and confirms the control mode corresponding to the closest value. A difference value between the closet value and the recorded value is lowest.

In block S15, the second determination module 105 determines whether the first shaking frequency is updated in a second predetermined time limit (e.g. 3 seconds) after outputting the audio file by the voice output device 50. In one embodiment, the second predetermined time limit may be the same as the first predetermines time limit. If the first shaking frequency is updated, block S16 is implemented. If the first shaking frequency is not updated, block 17 is implemented.

In block S16, the process module 106 confirms a second shaking frequency of the electronic device 1, and confirms the control mode corresponding to the second shaking frequency. The process module 106 subtracts the first shaking frequency from the updated first shaking frequency for obtaining the second shaking frequency.

In block S17, the process module 106 controls the alarm function of the electronic device 1 according to the confirmed control mode. For example, if the confirmed control mode is the close mode for turning off the alarm function, the process module 106 turns off the alarm function.

All of the processes described above may be embodied in, and be fully automated via, functional code modules executed by one or more general-purpose processors. The code modules may be stored in any type of non-transitory readable medium or other storage device. Some or all of the methods may alternatively be embodied in specialized hardware. Depending on the embodiment, the non-transitory readable medium may be a hard disk drive, a compact disc, a digital video disc, a tape drive or other suitable storage medium.

The described embodiments are merely possible examples of implementations, and have been set forth for a clear understanding of the principles of the present disclosure. Many variations and modifications may be made without departing substantially from the spirit and principles of the present disclosure. All such modifications and variations are intended to be included herein within the scope of this disclosure and the described inventive embodiments, and the present disclosure is protected by the following claims.

The invention is claimed is:

1. A computer-implemented method of an electronic device comprising an alarm function, the method comprising:

(a) setting an alarm time, an alarm mode and a plurality of control modes of the alarm function, and setting a shaking frequency and an audio file corresponding to each of the plurality of control modes in a storage system of the electronic device;

(b) starting the alarm function by activating the alarm mode and monitoring acceleration values of the electronic device using a monitor unit of the electronic device when a current time of the electronic device matches the alarm time;

(c) recording a first shaking frequency of the electronic device in a first predetermined time limit, according to the acceleration values from the monitor unit;

(d) confirming the control mode corresponding to the first shaking frequency, and outputting the audio file corresponding to the confirmed control mode to a voice output device of the electronic device;

(e) controlling the alarm function according to the confirmed control mode.

2. The method as claimed in claim 1, wherein between the step (d) and the step (e), the method further comprises:

(d1) determining whether the first shaking frequency is updated in a second predetermined time limit after outputting the audio file to the voice output device;

(d2) confirming a second shaking frequency, and confirming the control mode corresponding to the second value shaking frequency if the first shaking frequency is updated.

3. The method as claimed in claim 2, wherein the second shaking frequency is confirmed by subtracting the first shaking frequency from the updated first shaking frequency.

4. The method as claimed in claim 2, wherein the first shaking frequency is recorded by incrementing a value of the first shaking frequency by one if one of the acceleration values exceeds a predetermined shaking value, an initial value of the first shaking frequency is set as 0, and the predetermined shaking value is a threshold for indicating that the electronic device has been shaken.

5. The method as claimed in claim 1, wherein the alarm mode is a ring mode or a vibration mode, and the control modes comprise a close mode for turning off the alarm function, a first delay mode for the alarm function to ring again after a first time duration, and a second delay mode to ring again after a second time duration.

6. The method as claimed in claim 1, wherein the audio file of each of the control modes comprising voice content of the each of the control modes.

7. A non-transitory computer readable storage medium storing a set of instructions, when executed by at least one processor of an electronic device, cause the at least one processor to perform a method of the electronic device comprising an alarm function, the method comprising:

(a) setting an alarm time, an alarm mode and a plurality of control modes of the alarm function, and setting a shaking frequency and an audio file corresponding to each of the plurality of control modes in a storage system of the electronic device;

(b) starting the alarm function by activating the alarm mode and monitoring acceleration values of the electronic device using a monitor unit of the electronic device, when a current time of the electronic device matches the alarm time;

(c) recording a first shaking frequency of the electronic device in a first predetermined time limit, according to the acceleration values from the monitor unit;

(d) confirming the control mode corresponding to the first shaking frequency, and outputting the audio file corresponding to the confirmed control mode to a voice output device of the electronic device;

(e) controlling the alarm function according to the confirmed control mode.

8. The non-transitory computer readable storage medium as claimed in claim 7, wherein between the step (d) and the step (e), the method further comprises:

(d1) determining whether the first shaking frequency is updated in a second predetermined time limit after outputting the audio file to the voice output device;

(d2) confirming a second shaking frequency, and confirming the control mode corresponding to the second value shaking frequency if the first shaking frequency is updated.

9. The non-transitory computer readable storage medium as claimed in claim 8, wherein the second shaking frequency is confirmed by subtracting the first shaking frequency from the updated first shaking frequency.

10. The non-transitory computer readable storage medium as claimed in claim 8, wherein the first shaking frequency is recorded by incrementing a value of the first shaking frequency by one if one of the acceleration values exceeds a predetermined shaking value, an initial value of the first shaking frequency is set as 0, and the predetermined shaking value is a threshold for indicating that the electronic device has been shaken.

11. The non-transitory computer readable storage medium as claimed in claim 7, wherein the alarm mode is a ring mode or a vibration mode, and the control modes comprise a close mode for turning off the alarm function, a first delay mode for the alarm function to ring again after a first time duration, and a second delay mode to ring again after a second time duration.

12. The non-transitory computer readable storage medium as claimed in claim 7, wherein the audio file of each of the control modes comprising voice content of the each of the control modes.

13. An electronic device, comprising:

a monitor unit;

a voice output device;

a storage system;

at least one processor; and one or more programs that are stored in the storage system and executed by the at least one processor, the one or more programs comprising:

a setting module that sets an alarm time, an alarm mode, a plurality of control modes of an alarm function of the electronic device, and setting a shaking frequency and an audio file corresponding to each of the plurality of control modes in the storage system;

a starting module that starts the alarm function by activating the alarm mode and monitors acceleration values of the electronic device using a monitor unit of the electronic device, when a current time of the electronic device matches the alarm time;

a reading module that records a first shaking frequency of the electronic device in a first predetermined time limit, according to the acceleration values from the monitor unit;

an output module that confirms the control mode corresponding to the first shaking frequency, and outputs the audio file corresponding to the confirmed control mode to a voice output device of the electronic device;

a process module that controls the alarm function according to the confirmed control mode.

14. The electronic device as claimed in claim 13, wherein the one or more programs further comprises a determination module that determines whether the first shaking frequency is updated in a second predetermined time limit after outputting the audio file to the voice output device; and the process module further confirms a second shaking frequency, and confirming the control mode corresponding to the second value shaking frequency if the first shaking frequency is updated.

15. The electronic device as claimed in claim 14, wherein the second shaking frequency is confirmed by subtracting the first shaking frequency from the updated first shaking frequency.

16. The electronic device as claimed in claim 14, wherein the recording module records the first shaking frequency by incrementing a value of the first shaking frequency by one if one of the acceleration values exceeds a predetermined shaking value, an initial value of the first shaking frequency is set as 0, and the predetermined shaking value is a threshold for indicating that the electronic device has been shaken.

17. The electronic device as claimed in claim 13, wherein the alarm mode is a ring mode or a vibration mode, and the control modes comprise a close mode for turning off the alarm function, a first delay mode for the alarm function to ring again after a first time duration, and a second delay mode to ring again after a second time duration.

18. The electronic device as claimed in claim 13, wherein the audio file of each of the control modes comprising voice content of the each of the control modes.

* * * * *